US007702414B2

(12) United States Patent
Okura et al.

(10) Patent No.: US 7,702,414 B2
(45) Date of Patent: Apr. 20, 2010

(54) CUTTING-OFF CONTROL APPARATUS AND METHOD FOR A PRINTING MACHINE

(75) Inventors: Tetsuya Okura, Hiroshima (JP); Shinichiro Senoo, Hiroshima (JP); Masayasu Ogawa, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 556 days.

(21) Appl. No.: 11/612,065

(22) Filed: Dec. 18, 2006

(65) Prior Publication Data

US 2007/0144373 A1 Jun. 28, 2007

(30) Foreign Application Priority Data

Dec. 19, 2005 (JP) ..... 2005-365216

(51) Int. Cl.
*B65H 23/04* (2006.01)
*B65H 35/04* (2006.01)

(52) U.S. Cl. ..... 700/127; 700/125; 101/226; 226/2

(58) Field of Classification Search ..... 700/125, 700/127; 226/2, 28; 101/226, 227; 83/365, 83/367

See application file for complete search history.

(56) References Cited

U.S. PATENT DOCUMENTS 4,366,753 A * 1/1983 Glanz et al. ..... 101/181
4,415,978 A * 11/1983 Craemer et al. ..... 700/167
2006/0005722 A1* 1/2006 Nobukawa et al. ..... 101/181

FOREIGN PATENT DOCUMENTS

| | | | |
|---|---|---|---|
| JP | 0464563 A | | 2/1992 |
| JP | 05-016336 A | | 1/1993 |
| JP | 5-330022 A | | 12/1993 |
| JP | 2004-082279 | * | 3/2004 |
| JP | 2004-082279 A | | 3/2004 |
| JP | 2004-082280 A | | 3/2004 |

OTHER PUBLICATIONS

European Search Report mailed Jul. 3, 2007 for EP 06025703.
Instruction Manual Cutmatic Model CT5000, Apr. 2003. See Partial Translation: p. 11, col. 1 and Figure; and p. 36, col. 4 and Figure.

* cited by examiner

*Primary Examiner*—Ramesh B Patel
*Assistant Examiner*—Steven R Garland

(57) ABSTRACT

To prevent incorrect recognition of marks on a web, and to lighten a load to memory and arithmetic systems associated with mark recognition, a control apparatus for a printing machine includes a positional relationship acquisition means for previously obtaining a positional relationship between a position in a web traveling direction of each of the marks and a target cutting-off position of the web, and a detection timing control means for controlling mark detection timing so that the detection of each of the marks by a mark detector is performed during a specified period based on the positional relationship.

19 Claims, 8 Drawing Sheets

CUTTING-OFF CONTROL APPARATUS AND METHOD FOR A PRINTING MACHINE

RELATED APPLICATIONS

The present application is based on, and claims priority from, Japanese Application Number 2005-365216, filed Dec. 19, 2005, the disclosure of which is hereby incorporated by reference herein in its entirety.

BACKGROUND OF THE INVENTION (1) Field of the Invention

The present invention relates to a cutting-off control apparatus and method for a printing machine which are suitable for cutting off at a predetermined position a web having images printed thereon.

(2) Description of the Background Art

In conventional rotary web printing machines, etc., there is provided a web cutting-off control apparatus which controls a cutting-off position so that, when a web after being printed is cut off in the web width direction, the cutting-off position does not shift in the web flowing direction (e.g., see Japanese Patent Laid-Open Publication No. Hei 5-330022).

As shown in FIG. 10, a web 1 is conveyed from a paper feed section 51 through a series of guide rollers 52 and to a printing unit 53, in which images are transferred to the web 1. Thereafter, the web 1 is dried by a dryer section 54, passes through a web pass section 55, and is conveyed to a folding machine 56, in which the web 1 is cut off in the web width direction by a sawing cylinder 60. At this time, a cutting-off control apparatus controls the cutting-off position of the web 1 so that the web 1 is cut off at a predetermined position.

That is, in the control of the cutting-off position by the cutting-off control apparatus, a cut register mark (hereinafter referred to as a cut mark or simply a mark) printed on the web 1 is detected by a mark detector 57, and based on a detection signal from the mark detector 57 and a reference pulse from an encoder 61 rotating in synchronization with the sawing cylinder 60 of the folding machine 56, a controller 62 shown in FIG. 10 drives a motor 58 so that the timing at which the web 1 is cut off by the sawing cylinder 60 and the timing at which the mark is detected by the mark detector 57 coincide with each other or are within a predetermined difference. The rotation of the motor 58 causes a compensator roller 59 to move in the up-and-down direction. Since the up-and-down movement of the compensator roller 59 can finely adjust the travel path length of the web 1 to finely adjust the phase of the web 1 relative to the rotation phase of the sawing cylinder 60, the cutting-off position of the web 1 can be kept constant. However, in this example, while the compensator roller 59 is controlled in the up-and-down direction, it may be controlled in a different direction (e.g., a right-and-left direction), depending upon the arrangement of the compensator roller 59. That is to say, the compensator roller 59 may be moved in any direction, so long as the movement thereof can finely adjust the travel path length of the web 1.

The above-described cut mark is normally formed into a slender rectangle extending in the web width direction, and it is standard to print the cut mark outside an image area, but in recent years, there has been developed a cutting-off control technique which does not print an image and a separate mark together but considers a specified portion of an image as a cut mark. In the following description, such a specified portion of an image considered as a cut mark refers to as a mark equivalent or simply a mark.

On the other hand, the mark detector 57 is a sensor that responds to light reflected from the web 1, and it is a matter of course that the detection area (visual field) thereof is limited. The mark detector 57 cannot detect a mark if it does not pass through the visual field thereof. As shown in FIG. 11A, in the case where the mark 2 is at a predetermined constant position such as a position which is within a printable area between images 3 printed on the web 1 and near one end in the width direction of the web 1, if the mark detector 57 is installed according to the mark position, the mark 2 can pass through the visual field of the mark detector 57. However, if the mark position is shifted widthwise from the constant position, the mark 2 will pass through a position shifted from the visual field of the mark detector 57 and therefore it will not be detected.

Hence, the inventors have proposed a technique for controlling the width direction of the mark detector 57 according to the position in the width direction of a mark (see Japanese Patent Laid-Open Publication No. 2004-82279).

In this technique, the resolution of image data for plate making (or image data obtained by processing the image data for plate making) is converted to the resolution of the mark detector. And based on the converted image data, the position of a mark on a web is calculated, and based on the calculated mark position, the mark detector is moved to the mark position in the web width direction before the start of printing. This makes it possible to detect the mark on the web at the start of printing and to keep the web cutting-off position constant, whereby waste paper can be considerably reduced.

The above-described mark detector detects the mark on the web by a change in light quantity (luminous intensity) reflected from the web which travels. That is, a light quantity reflected from the web is strong for white paper, but becomes very weak at a place where a large quantity of ink is transferred, such as solid printing (halftone area ratio=100%), like a cut mark. Therefore, a rapid change in reflected light quantity (strong to weak, or weak to strong) makes it possible to detect the cut mark.

However, since the web surface (printed surface) which passes through the detection area of the mark detector does not always have only cut marks, there is a possibility that a part not being a cut mark will be incorrectly recognized as a mark.

That is, as shown in FIG. 11A, in the case where the cut mark 2 is present in the margin shifted in the web width direction from the printing area of the image 3 on the web 1, a part changing sharply in reflected light quantity can be recognized as the cut mark 2. However, as shown in FIG. 11B, in the case where the mark 2 is present in the margin between the image printing areas, the image 3 also pass through the detection area of the mark detector 57. Therefore, if the image 3 contains a part changing sharply in reflected light quantity, there is a possibility that this part will be incorrectly recognized as the mark 2. In addition, as shown in FIG. 11C, in the case where an edge portion 5 in the image 3 is handled as a mark equivalent, if the remaining part in the image 3 passing through the detection area of the mark detector 57 contains a portion changing sharply in reflected light quantity, there will be possibility that the portion will be incorrectly recognized as the mark 2.

Thus, if the cut mark, including the mark equivalent, is incorrectly recognized, the web will cut off at an inappropriate position and therefore the operator will need to make adjustments. In addition, all of the sheets cut off during this period will become waste paper.

As shown in FIGS. 11A to 11C, although the mark 2, or the edge portion 5 of the image 3 as the mark equivalent, is a specified part in the traveling direction of the web 1, the above-described incorrect mark recognition is caused by the mark detecting system that detects the mark or mark equivalent over all of the area in the traveling direction of the web 1. In addition, such a system causes a great load to memory and arithmetic systems associated with mark recognition.

SUMMARY OF THE INVENTION

The present invention has been made in view of the problems described above. Accordingly, it is the primary object of the present invention to provide a cutting-off control apparatus and method for a printing machine that are capable of preventing incorrect mark recognition and lightening a load to memory and arithmetic systems associated with the decision of mark detection, by previously recognizing the position in a web traveling direction of a mark relative to a printed image and limiting the detection of the mark by a mark detector to a specified place which corresponds to the recognized mark position.

To achieve the above object and in accordance with the present invention, there is provided a cutting-off control apparatus for a printing machine, which comprises five major components: (1) a sawing cylinder for cutting off a web which has images printed thereon; (2) a mark detector provided upstream of the sawing cylinder for detecting marks on the web; (3) a compensator roller for increasing or reducing a travel path length of the web, based on a difference between timing at which the web is cut off by the sawing cylinder and timing at which each of the marks is detected by the mark detector, to adjust a cutting-off position at which the web is cut off by the sawing cylinder; (4) positional relationship acquisition means for previously obtaining a positional relationship between a position in a web traveling direction of each of the marks to be printed on the web and a target cutting-off position of the web; and (5) detection timing control means for controlling mark detection timing so that the detection of each of the marks by the mark detector is performed during a specified period based on the positional relationship obtained by the positional relationship acquisition means.

According to the cutting-off control apparatus of the present invention, the compensator roller is controlled based on a difference between the timing at which the web is cut off by the sawing cylinder and the timing at which each of the marks is detected by the mark detector. Therefore, the compensator roller varies the travel path length of the web to adjust a cutting-off position at which the web is cut off.

At this time, the positional relationship between the position in a web traveling direction of each of the marks to be printed on the web and a target cutting-off position of the web is obtained beforehand, and during a specified period based on the obtained positional relationship, the detection of each of the marks by the mark detector is performed. Therefore, since the mark detection timing is specified, the mark detection is performed only for specified areas on the web, and consequently, the possibility of incorrect mark recognition can be reduced. This can contribute to a reduction in waste paper. In addition, since a load to memory and arithmetic systems associated with the decision of mark detection can be lightened, the memory and arithmetic systems can be cheaply constructed.

Note that the above specified period is set to contain the timing at which a predetermined edge of the aforementioned mark passes through the detection area of the mark detector.

In the cutting-off control apparatus of the present invention, the positional relationship acquisition means preferably includes image data storage means for storing first image data for plate making or second image data obtained by processing the first image data; and image data conversion means for converting a resolution of the first or second image data stored in the image data storage means to a resolution of the mark detector. The positional relationship acquisition means preferably calculates the position in the web traveling direction of each of the marks relative to the target cutting-off position, based on image data converted by the image data conversion means. Accordingly, the positional relationship, that is, the position in the web traveling direction of each of the marks relative to the target cutting-off position can be appropriately calculated, the mark detection timing can be suitably specified, and the detection of each of the marks by the mark detector can be made easier with reliability.

The cutting-off control apparatus of the present invention may further include a reference signal generator for outputting a signal according to cutting-off timing at which the web is cut off by the sawing cylinder. In this case, the detection timing control means preferably sets the mark detection timing based on a signal from the reference signal generator and causes the mark detector to detect each of the marks at the set mark detection timing. Accordingly, since the setting of each of the marks detection timing can be appropriately performed, the detection of each of the marks by the mark detector can be made easier with reliability.

When each of the marks is not detected as a result of the detection of each of the marks at the set mark detection timing by the mark detector, the detection timing control means preferably shifts the set mark detection timing either back or forth and then causes the mark detector to detect the mark at the shifted mark detection timing. Accordingly, even in the case where the passing timing of each of the marks on the web is shifted due to expansion and contraction of the web, mark detection can be reliably performed.

Preferably, the cutting-off control apparatus of the present invention further includes mark position acquisition means for obtaining a position in a web width direction of each of the marks to be printed on the web; drive means for moving the mark detector in a width direction of the web; and detector position control means for controlling the drive means based on the position in the web width direction of each of the marks obtained by the mark position acquisition means, before start of printing. Accordingly, even when each of the marks is at any position in the web width direction, the mark detector is moved in the web width direction according to the position in the web width direction of each of the marks. Thus, it becomes possible to detect the mark printed on the web at the start of printing. This can contribute to a reduction in waste paper.

In the cutting-off control apparatus of the present invention, each of the marks is preferably a specified portion of each of the images printed on the web. Accordingly, it is not necessary to print a dedicated mark outside an image (i.e., a blank outside the image), whereby the setting of marks required at the stage of plate making becomes unnecessary. In addition, when a blank outside an image is small, the mark setting will become fairly difficult, but such trouble can be avoided. On the other hand, there is a strong possibility of incorrectly recognizing marks, but as described above, the possibility of incorrect recognition can be reduced and therefore it becomes possible to recognize marks properly to suppress the occurrence of waste paper.

In accordance with the present invention, there is provided a cutting-off control method for a printing machine which comprises a sawing cylinder for cutting off a web which has images printed thereon; a mark detector provided upstream of the sawing cylinder for detecting marks on the web; and a compensator roller for increasing or reducing a travel path length of the web, based on a difference between timing at which the web is cut off by the sawing cylinder and timing at which each of the marks is detected by the mark detector, to adjust a cutting-off position at which the web is cut off by the sawing cylinder. The method includes (1) a positional relationship acquisition step of previously obtaining a positional relationship between a position in a web traveling direction of each of the marks to be printed on the web and a target cutting-off position of the web; and (2) a mark detection timing control step of controlling mark detection timing so that the detection of each of the marks by the mark detector is performed during a specified period based on the positional relationship obtained in the positional relationship acquisition step.

According to the cutting-off control method of the present invention, the compensator roller is controlled based on a difference between the timing at which the web is cut off by the sawing cylinder and the timing at which each of the marks is detected by the mark detector. Therefore, the compensator roller varies the travel path length of the web to adjust a cutting-off position at which the web is cut off.

At this time, the positional relationship between the position in a web traveling direction of each of the marks to be printed on the web and a target cutting-off position of the web is obtained beforehand, and during a specified period based on the obtained positional relationship, the detection of each of the marks by the mark detector is performed. Therefore, since the mark detection timing is specified, the mark detection is performed only for specified areas on the web, and consequently, the possibility of incorrect mark recognition can be reduced. This can contribute to a reduction in waste paper. In addition, since a load to memory and arithmetic systems associated with the decision of mark detection can be lightened, the memory and arithmetic systems can be cheaply constructed.

In the cutting-off control method of the present invention, the positional relationship acquisition step preferably includes an image data storage step of storing first image data for plate making or second image data obtained by processing the first image data; an image data conversion step of converting a resolution of the first or second image data stored in the image data storage step to a resolution of the mark detector; and a mark position calculation step of calculating the position in the web traveling direction of each of the marks relative to the target cutting-off position, based on image data converted by the image data conversion step. Accordingly, the positional relationship, that is, the position in the web traveling direction of each of the marks relative to the target cutting-off position can be appropriately calculated, the mark detection timing can be suitably specified, and the detection of each of the marks by the mark detector can be made easier with reliability.

In the cutting-off control method of the present invention, the printing machine preferably includes reference signal generator for outputting a signal according to cutting-off timing at which the web is cut off by the sawing cylinder. In this case, the detection timing control step preferably sets the mark detection timing based on a signal from the reference signal generator and causes the mark detector to detect each of the marks at the set mark detection timing. Accordingly, since the setting of the mark detection timing can be appropriately performed, the detection of each of the marks by the mark detector can be made easier with reliability.

In the cutting-off control method of the present invention, when each of the marks is not detected as a result of the detection of each of the marks at the set mark detection timing by the mark detector, the detection timing control step preferably shifts the set mark detection timing either back or forth and then causes the mark detector to detect the mark at the shifted mark detection timing. Accordingly, even in the case where the passing timing of each of the marks on the web is shifted due to expansion and contraction of the web, mark detection can be reliably performed.

Preferably, the cutting-off control method of the present invention further includes a mark position acquisition step of obtaining a position in a web width direction of each of the marks to be printed on the web; and a detector position control step of moving the mark detector in a width direction of the web, based on the position in the web width direction of each of the marks obtained by the mark position acquisition step, before start of printing. Accordingly, even when each of the marks is at any position in the web width direction, the mark detector is moved in the web width direction according to the position in the web width direction of each of the marks. Thus, it becomes possible to detect the mark printed on the web at the start of printing. This can contribute to a reduction in waste paper.

In the cutting-off control method of the present invention, each of the marks is preferably a specified portion of each of the images printed on the web. Accordingly, it is not necessary to print a dedicated mark outside an image (i.e., a blank outside the image), whereby the setting of marks required at the stage of plate making becomes unnecessary. In addition, when a blank outside an image is small, the mark setting will become fairly difficult, but such trouble can be avoided. On the other hand, there is a strong possibility of incorrectly recognizing marks, but as described above, the possibility of incorrect recognition can be reduced and therefore it becomes possible to recognize marks properly to suppress the occurrence of waste paper.

BRIEF DESCRIPTION OF THE DRAWINGS

The present invention will be described in further detail with reference to the accompanying drawings wherein.

DESCRIPTION OF THE PREFERRED EMBODIMENTS

A preferred embodiment of the present invention will be described hereinafter with reference to the drawings.

Figure 1:
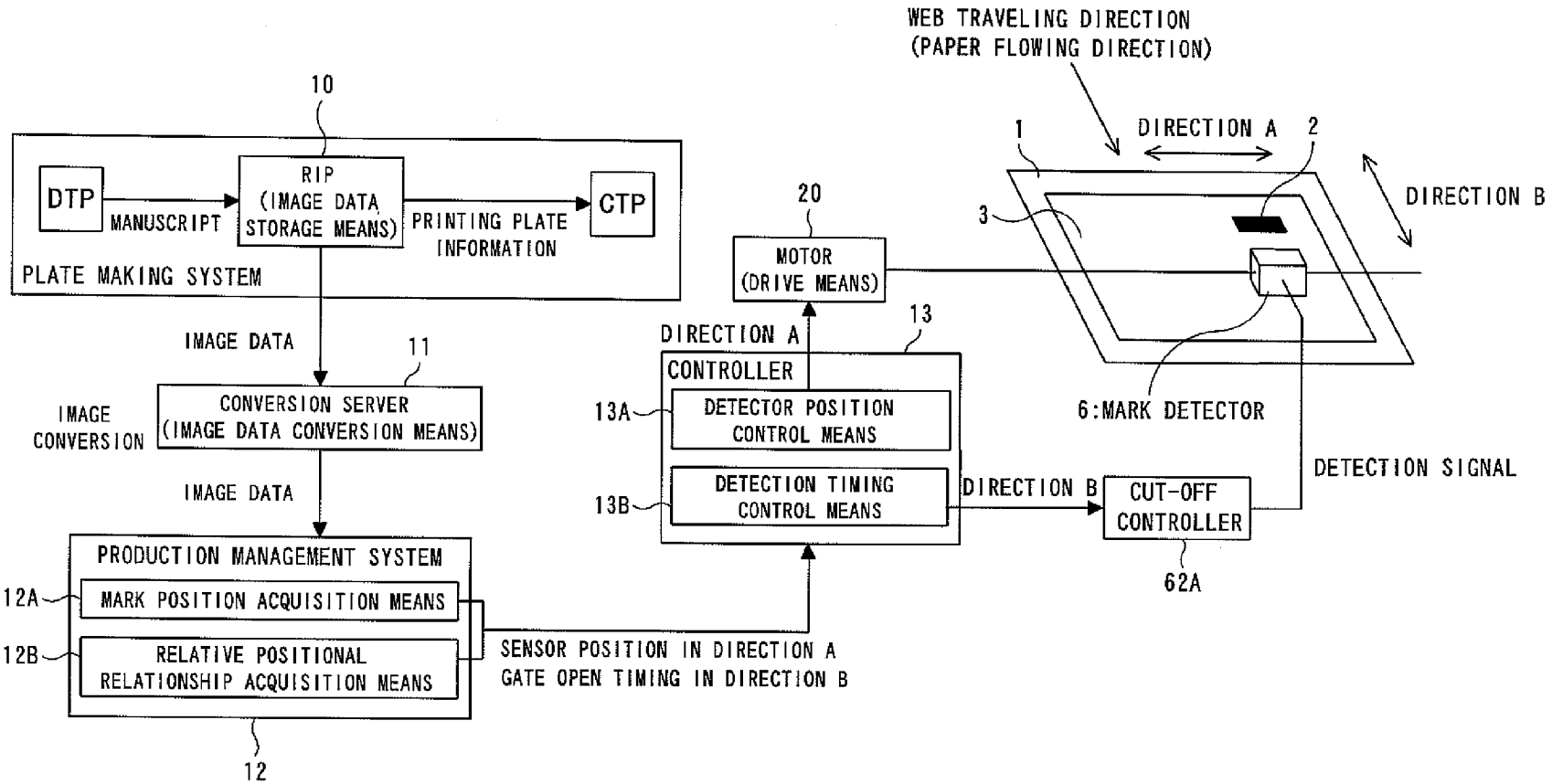
FIG. 1 is a block diagram schematically showing a cutting-off control apparatus constructed in accordance with a preferred embodiment of the present invention.
Figure 2:
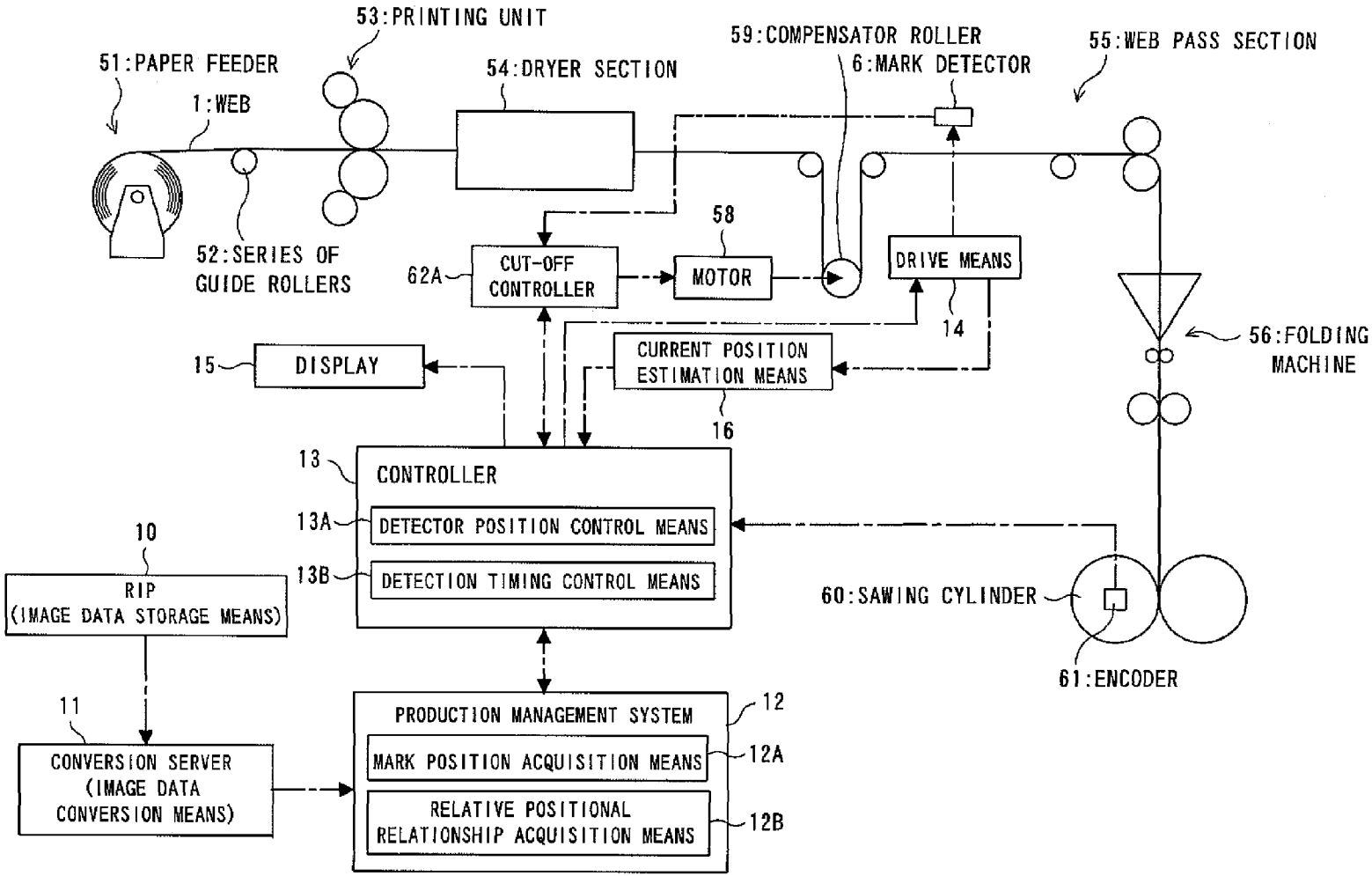
FIG. 2 is a block diagram schematically showing a printing machine to which the cutting-off control apparatus of the preferred embodiment is applied.

FIG. 1 is a block diagram schematically showing a cutting-off control apparatus constructed in accordance with a preferred embodiment of the present invention. FIG. 2 is a block diagram schematically showing a printing machine to which the cutting-off control apparatus of the preferred embodiment is applied.

As shown in FIGS. 1 and 2, a web 1 is conveyed from a paper feeder 51 through a series of guide rollers 52 and to a printing unit 53, in which images are transferred to the web 1. Thereafter, the web 1 is dried in a dryer section 54; is conveyed to a folding machine 56 through a web pass section 55; and is cut off in the web width direction by a sawing cylinder 60.

At this time, in the cutting-off control apparatus for the printing machine of the preferred embodiment, based on a reference pulse from an encoder 61 rotating in synchronization with the sawing cylinder 60 and a detection signal from a mark detector 6 such as a photo diode for detecting a mark (edge portion of an image) 2 on the web 1 having images printed thereon, a controller 13 drives a compensator roller 59 through a motor 58 so that the timing at which the web 1 is cut off by the sawing cylinder 60 and the timing at which the mark 2 is detected by the mark detector 6 coincide with each other or are within a predetermined difference. The compensator roller 59 functions to vary the travel path length of the web 1 to adjust the above-described timing difference, that is, a shift in the cutting-off position. In this manner, the web 1 can be cut off at a predetermined position.

The cutting-off control apparatus also includes image data storage means 10, image data conversion means 11, mark position acquisition means 12A, positional relationship acquisition means 12B, detector position control means 13A, detection timing control means 13B, drive means 14 for the mark detector 6, a display 15, and current position estimation means 16 for estimating the current position of the mark detector 6.

The image data storage means 10 is used for obtaining and storing image data, in which an image to be printed in the printing unit 53 originates [digital data for plate making which is used in a CTP system, or image data obtained by processing the image data in which an image to be printed in the printing unit 53 originates (e.g., digital data based on the CIP3/4-PPF standard)], online from a plate-making process. As shown in FIG. 1, the preferred embodiment employs image data stored in a plate-making system which comprises DTP (Desktop Publishing), RIP (Raster Image Processor), and CTP (Computer to Plate).

That is, in the plate making system, characters, line drawings, and photographs are edited and produced by DTP; image data of C, M, Y, and K for printing are produced from manuscript data produced with DTP by RIP; and a printing plate is produced directly from image data (digital data) produced with RIP by CTP. The image data associated with the cutting-off control apparatus of the preferred embodiment is produced and stored by the RIP, the data storage section of which corresponds to the image data storage means 10. As to this image data, for example, image data in which an image to be printed on the web 1 originates is stored in the image data storage means 10 with a resolution of about 2400 dpi, while digital data based on the CIP3/4-PPF standard is stored with a resolution of about 50 to 60 dpi.

The image data conversion means 11 is used for converting the resolution 2400 dpi or 50 to 60 dpi of the above-described image data to the resolution 50.8 dpi of the mark detector 6 so that the resolution of the image data coincides with that of the mark detector 6. In the preferred embodiment, as shown in FIG. 1, a conversion server for obtaining image data from RIP is employed as the image data conversion means 11.

Figure 3:
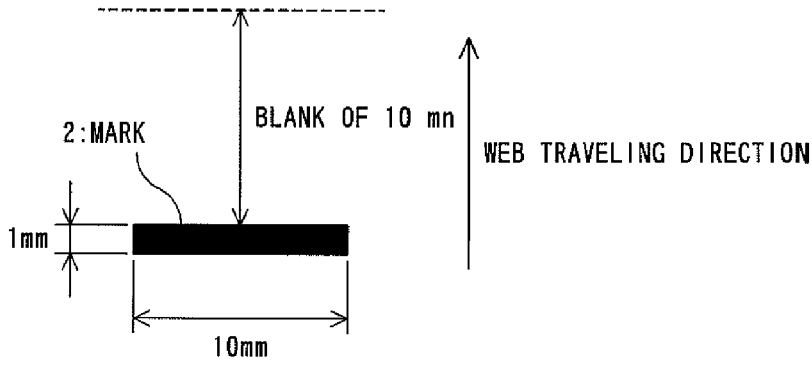
FIG. 3 is a plan view used for explaining the minimum dimensions of a mark that can be detected by the mark detector of the preferred embodiment.

As shown in FIG. 3, the minimum dimensions of the mark 2 that can be detected by the mark detector 6 of the preferred embodiment are 10 mm in width in the web width direction and 1 mm in length in the web flowing direction. In addition, in order to detect the mark 2 with the mark detector 6, a margin of 10 mm or greater is needed above the mark 2 (i.e., upstream of the mark 2) shown in FIG. 3. In the preferred embodiment, to obtain a mark position indication accuracy of 0.5 mm, the resolution of the image data is converted to 50.8 dpi with the image conversion means 11. (In image data with a resolution of 50.8 dpi, a width equivalent to one pixel is 0.5 mm.)

Note that since the above-described mark position indication accuracy depends upon the visual field (detection area) of the mark detector 6, the mark position indication accuracy can be made coarser if the visual field of the mark detector 6 is wider. In the preferred embodiment, the mark detector 6 is able to find the mark 2 if it has an accuracy of 0.5 mm (i.e., the mark 2 enters the visual field of the mark detector 6).

The mark position acquisition means 12A and positional relationship acquisition means 12B are provided as the constituent elements of a production management system 12. The detector position control means 13A and detection timing control means 13B are provided as the constituent elements of a controller 13.

Figure 4A:
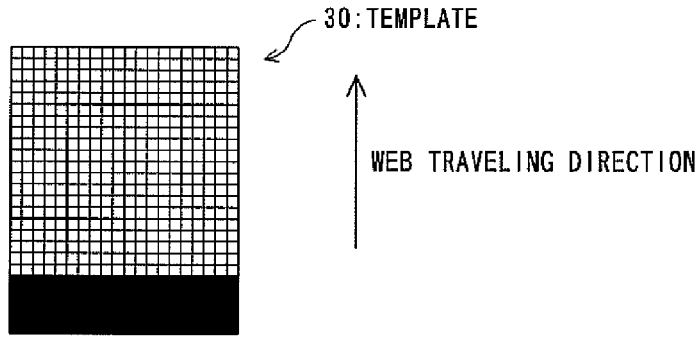
FIG. 4A is a diagram used for explaining the mark position calculation means of the preferred embodiment, a template being shown.
Figure 4B:
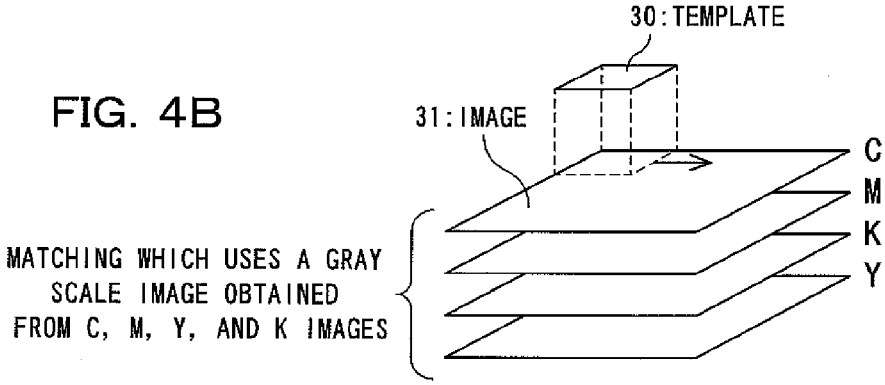
FIG. 4B is a diagram used for explaining pattern matching which uses the template shown in FIG. 4A.

The mark position acquisition means 12A, as shown in FIGS. 1 and 2, functions to calculate (obtain) a mark position based on image data scaled down in the image data conversion means 11. More specifically, as shown in FIG. 4B, an image 31 scaled down in the image data conversion means 11 is matched with a template 30 such as that shown in FIG. 4A to calculate a mark position. Note that the matching is performed using the following sequential similarity detection algorithm.

In the case of 50.8 dpi, one pixel corresponds to 0.5 mm. Therefore, in the template 30, the mark 2 and the blank in front of the mark 2 shown in FIG. 3 are ideally shown by pixels. The black portion of the template 30 corresponds to the mark 2, while the white portion corresponds to the blank. The black portion has the maximum value of a pixel, while the white portion is made zero.

First, the template 30 is placed on the upper left of an image converted; a difference between each pixel value of the template 30 and each pixel value at a position corresponding to the template 30 of the converted image 31 is calculated; and the differences are cumulated. When the cumulated value is a certain threshold value or less, this position (in this case, it corresponds to the upper left of the converted image 31) is recorded as a position where there is an image near to the template 30 (i.e., a position where the mark 2 is likely present). Next, the position of the template 30 is shifted by one pixel, and the same operation is performed so that the template 30 can scan sequentially on the converted image 31.

Note that since the mark detector 6 is well if it can sense the mark 2, processing is normally performed using a gray scale image (black-and-white image). This gray scale image is produced by stacking cyan (C), magenta (M), yellow (Y), and black (K) images given predetermined weights.

By such pattern matching, the mark position acquisition means 12A functions to calculate a plurality of mark candidates which are usable as the mark 2.

The mark position acquisition means 12A functions to select from the plurality of mark candidates the mark candidate nearest to the current position in the web width direction of the mark detector 6 estimated by the current position estimation means 16 described later, and also functions to set the selected mark candidate as an optimum mark, that is, a mark equivalent 2 (which is a specified portion of an image considered as a cut mark, and which will also be referred to simply as a mark).

Figure 6:
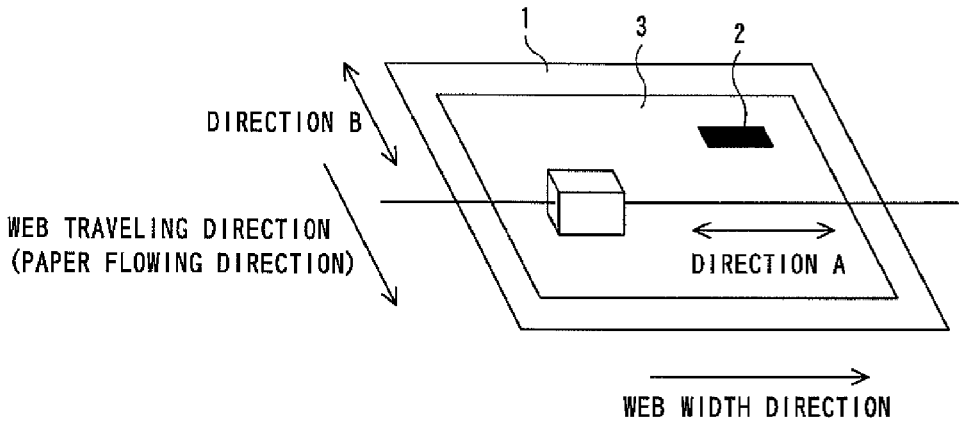
FIG. 6 is a perspective view used for explaining the traveling direction and width direction of a web.
Figure 7:
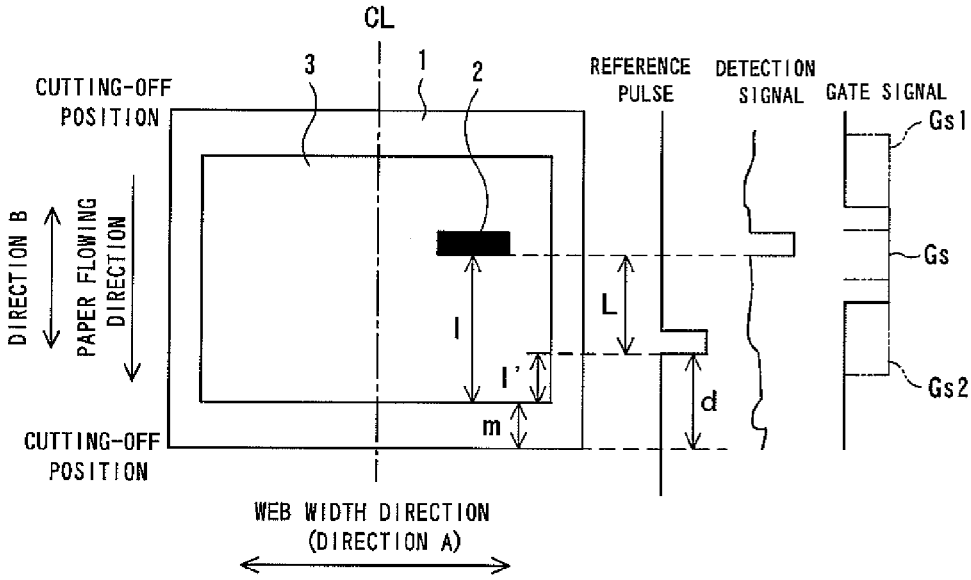
FIG. 7 is a plan view used for explaining the position in the traveling direction of the web and the position in the width direction of the web.

As a result, as shown in FIGS. 1, 6, and 7, the position in the web width direction (position in the direction A) and position in the web traveling direction (position in the web flowing direction B) of the mark 2 can be obtained. As to the position in the direction A, the transversely center line CL of the image printing area normally coincides with the transversely center line of the web 1. Therefore, if the transversely center line CL is used as a reference line, the position in the web width direction of the mark 2 based on the image data, as it is, can be employed as the position in the web width direction of the mark 2 relative to the web 1.

However, the position in the direction B of the mark 2 relative to the web 1, as shown in FIG. 7, depends upon the marginal distance m from the end of the image area 3 to the cutting-off position (target cutting-off position). Therefore, since the position in the direction B of the mark 2 relative to the web 1 cannot be determined by only the distance l from the end of the image area 3 to the mark 2, it is necessary to calculate the sum of the distance l and marginal distance m. Thus, in the relative position acquisition means 12B, the position x in the direction B of the mark 2 relative to the web 1 (i.e., the distance from the cutting-off position to the mark 2) is calculated and obtained as the sum of the distance l and marginal distance m ($x=l+m$).

The cutting-off timing of the sawing cylinder 60 can be grasped by a reference pulse signal, from the encoder (rotary encoder) 61 as a reference signal generator, which is output according to the cutting-off timing. However, the reference pulse signal does not always synchronize with the cutting-off timing and has a phase difference (timing difference) peculiar to each printing machine. If this phase difference is caused to correspond to the position of the web 1, it can be expressed by d shown in FIG. 7. The phase difference d can also be expressed as the sum of the distance l' from the end of the image area to the reference pulse signal and the marginal distance m ($d=l'+m$).

Therefore, to specify the position of the mark 2 with respect to the reference pulse signal, it is necessary to calculate a positional difference L between the reference pulse signal and the position of the mark 2. The positional difference L can be calculated from the position x in the direction B of the mark 2 relative to the web 1 (i.e., the distance from the cutting-off position to the mark 2) and the phase difference d. The distance x, as described above, is the sum of the distance l and the marginal distance m. The distance l can be calculated from image data, while the marginal distance m can be calculated from the length in the direction B of the image area 3 obtained from image data and the cutting-off length. Thus, the distance x can be calculated from these distances l and m. The phase difference d can be obtained beforehand as a value peculiar to the printing machine. Accordingly, the positional difference L can also be calculated. Note that since the web 1 is normally traveling at a constant speed, the positional difference L, as it is, can be replaced with a temporal difference.

Assuming that the mark 2 is present at a position shifted from the reference pulse signal by the positional difference L, the detection timing control means 13B outputs a gate signal Gs during a specified period containing the mark 2, and only during the period that the gate signal Gs is output, a detection signal from the mark detector 6 is taken in. Note that the taken-in mark detection signal is stored in a memory device not shown, but the output period (specified period) of the gate signal Gs is set according to the capacity of the memory device. The output or input of the detection signal of the mark detector 6 is received in a shorter cycle than the thickness in the direction B of the mark 2 when calculated in terms of the distance in the traveling direction B of the web 1, and is stored in a memory device. For instance, if the capacity of the memory device corresponds to 10 cycles (i.e., 10 signals), the period of the gate signal Gs is set to the period of 10 cycles.

Thus, if the period during which a detection signal from the mark detector 6 is taken in is limited by the gate signal Gs, the mark 2 will pass through the visual field of the mark detector 6 during the signal taking-in period and therefore normally the mark 2 can be detected without difficulty. However, in the case where the mark 2 is shifted due to expansion and contraction of the web 1, there is a possibility that the mark 2 can not be detected during the period of the gate signal Gs. In such a case, like Gs1 and Gs2 shown by two-dot chain lines in FIG. 7, by shifting the timing of the gate signal Gs back and forth by the amount of suitable cycles (e.g., 8 cycles) so that the gate signals Gs1 and Gs2 partially overlap with the original gate signal Gs, the mark 2 is detected.

Figure 5:
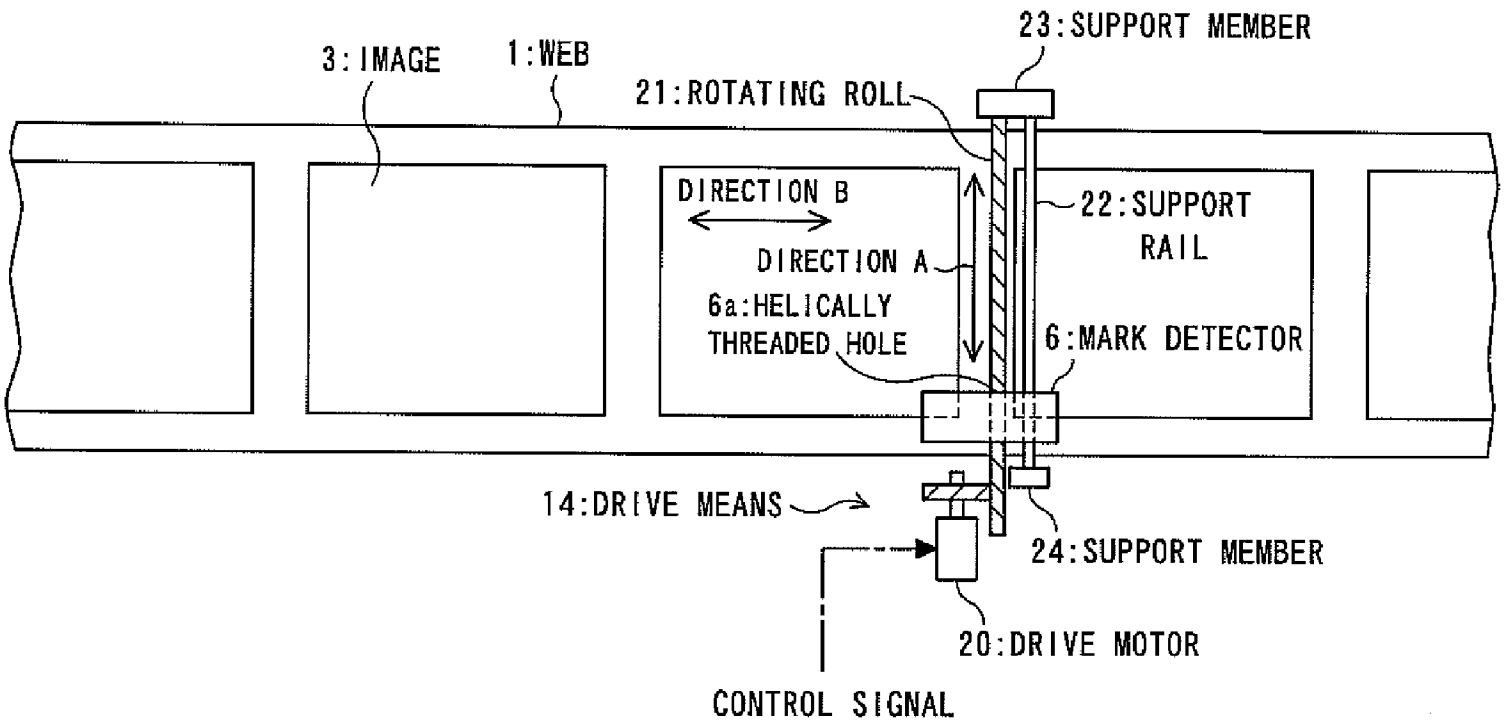
FIG. 5 is a diagram used for explaining the drive means of the preferred embodiment.

On the other hand, the drive means 14 of the mark detector 6, as shown in FIG. 5, includes support members 23 and 24 disposed on both sides of the web 1; a support rail 22 fixed at both ends thereof to the support members 23 and 24 for supporting the movement in the web width direction of the mark detector 6; a rotating roll 21 provided in parallel to the support rail 22 and having a helical groove which meshes with a helically threaded hole 6*a* of the mark detector 6; and a drive motor 20 connected to the other end of the rotating roll 21 for rotating the rotating roll 21 in response to a control signal from the controller 13.

Therefore, rotation of the drive motor 20 causes the rotating roll 21 to rotate, and by the rotation of the rotating roll 21, the mark detector 6 is able to move between both ends of the web 1.

The current position estimation means 16 is used for calculating, from the number of rotations of the drive motor 20 detected by a potentiometer not shown and the groove width of the helical groove of the rotating roll 21, how far the mark detector 6 is moved from a reference position (e.g., the position of the mark detector 6 show in FIG. 5), and estimating the current position in the web width direction of the mark detector 6.

The detector position control means 13A functions dive motor 20 to move the mark detector 6 in the web width direction to a mark detectable position calculated by the mark position calculation means 12A. If the mark detector 6 is moved to the mark detectable position, then the control means 13 controls the drive means 14 (particularly, drive motor 20) so that the mark detector 6 is stopped at that position.

The detector position control means 13A functions to display on a display 15 the distance between the above-describe mark position and the current position of the mark detector 6. For example, in FIG. 5, in the case where the above-described mark 2 passes through a position 30 cm above the mark detector 6, "+30 cm", etc., are displayed on the display 15. In the case where the above-described mark 2 passes through a position 5 cm below the mark detector 6, "−5 cm", etc., are displayed on the display 15. Accordingly, by watching the display 15, the operator can recognize which side and how far the mark detector 6 needs to be moved.

The cutting-off control apparatus for the printing machine as the preferred embodiment is constructed as described above. Therefore, before the start of printing, the image data conversion means 11 converts the resolution of first image data for plate making stored in the image data storage means 10 (or second image data obtained by processing the first image data) to the resolution of the mark detector 6.

Next, by pattern matching of the mark position acquisition means 12A, a plurality of mark candidates usable as the mark 2 are detected, and among the mark candidates, the position of the mark candidate nearest to the current position of the mark detector 6 estimated by the current position estimation means 16 is calculated and set as the mark 2. Based on the position in the web traveling direction of the set mark 2, the relative position acquisition means 12B calculates the position x in the direction B of the mark 2 relative to the web 1 (i.e., the distance from the cutting-off position to the mark 2).

Based on the positional information of the mark 2 calculated by the mark position acquisition means 12A, the detector position control means 13A drives the drive motor 20, and moves the mark detector 6 in the web width direction to a position at which the mark detector 6 can detect the mark. At this time, the distance between the position of the mark 2 and the current position of the mark detector 6 is displayed on the display 15.

After the movement of the mark detector 6 has been completed, normal printing is started and the web 1 is cut off.

By the time, the detection timing control means 13B calculates the positional difference L between the reference pulse signal and the mark 2, from the position x in the direction B of the mark 2 relative to the web 1 obtained by the positional relationship acquisition means 12B and the phase difference d between the cutting-off timing and the reference pulse of the encoder. Based on the positional difference L, the gate signal Gs is output, and only during the period that the gate signal Gs is output, the detection signal of the mark detector 6 is taken in.

This limits the detection of the mark detector 6 to a specified place where the mark 2 in the traveling direction of the web 1 is positioned. Since the detection of the mark detector 6 is limited to the specified place where the mark 2 is positioned, the possibility of incorrectly detecting an image similar to the mark 2 as the mark 2 can be greatly reduced.

In addition, a load to memory and arithmetic units associated with mark detection can be lightened. This can contribute to the cost suppression of these units.

However, it is considered that the mark 2 cannot be detected during the period of the gate signal Gs. In such a case, like Gs1 and Gs2 shown by two-dot chain lines in FIG. 7, by shifting the timing of the gate signal back and forth by the amount of suitable cycles (e.g., 8 cycles) so that the gate signals Gs1 and Gs2 partially overlap with the original gate signal Gs, the detection of the mark 2 is performed. Accordingly, the mark 2 can be reliably detected.

Figure 8:
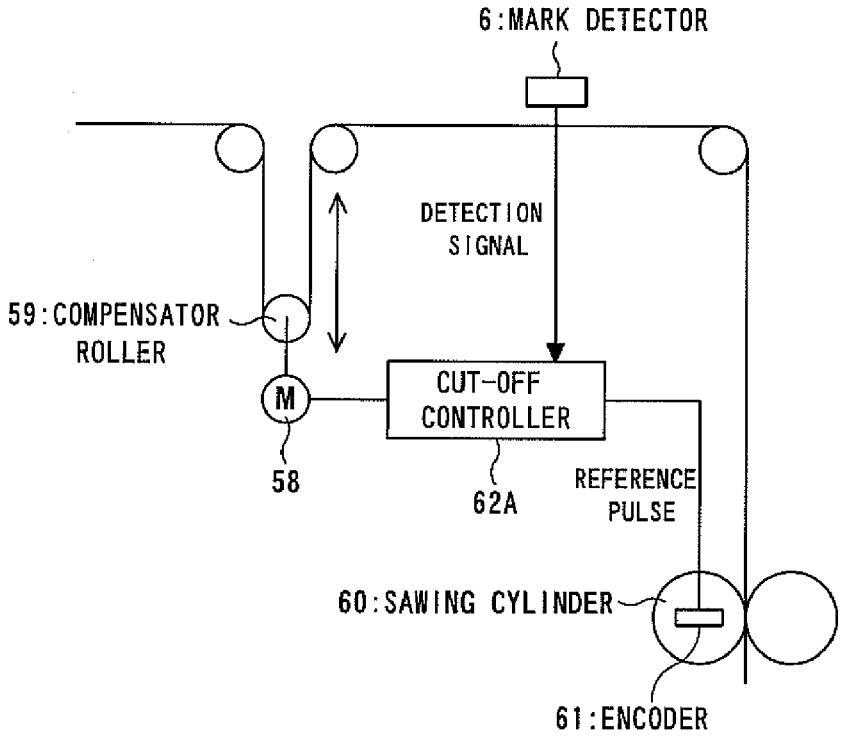
FIG. 8 is a block diagram schematically showing the essential part of the cutting-off control apparatus of the preferred embodiment.
Figure 9:
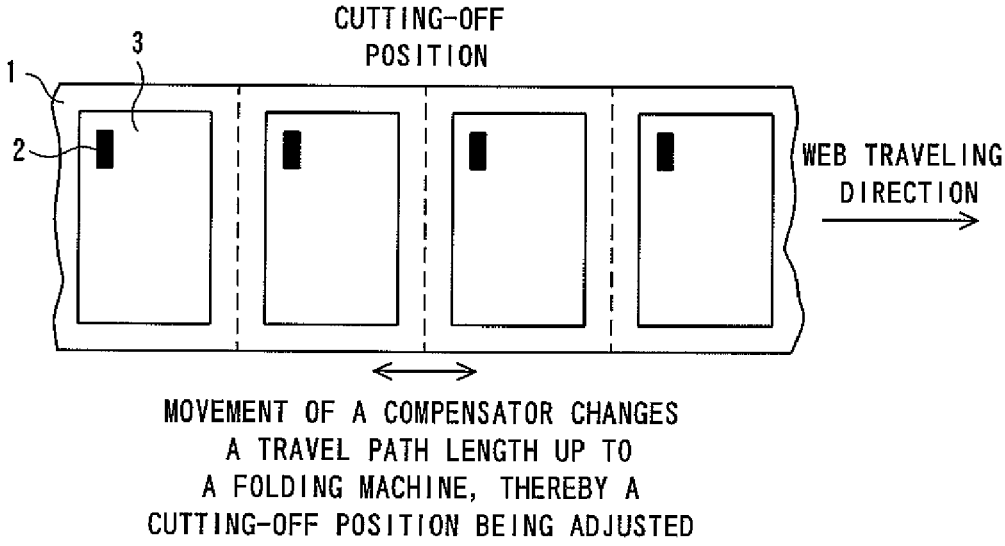
FIG. 9 is a plan view of the web used for explaining the functions of the cutting-off control apparatus of the preferred embodiment.
Figure 10:
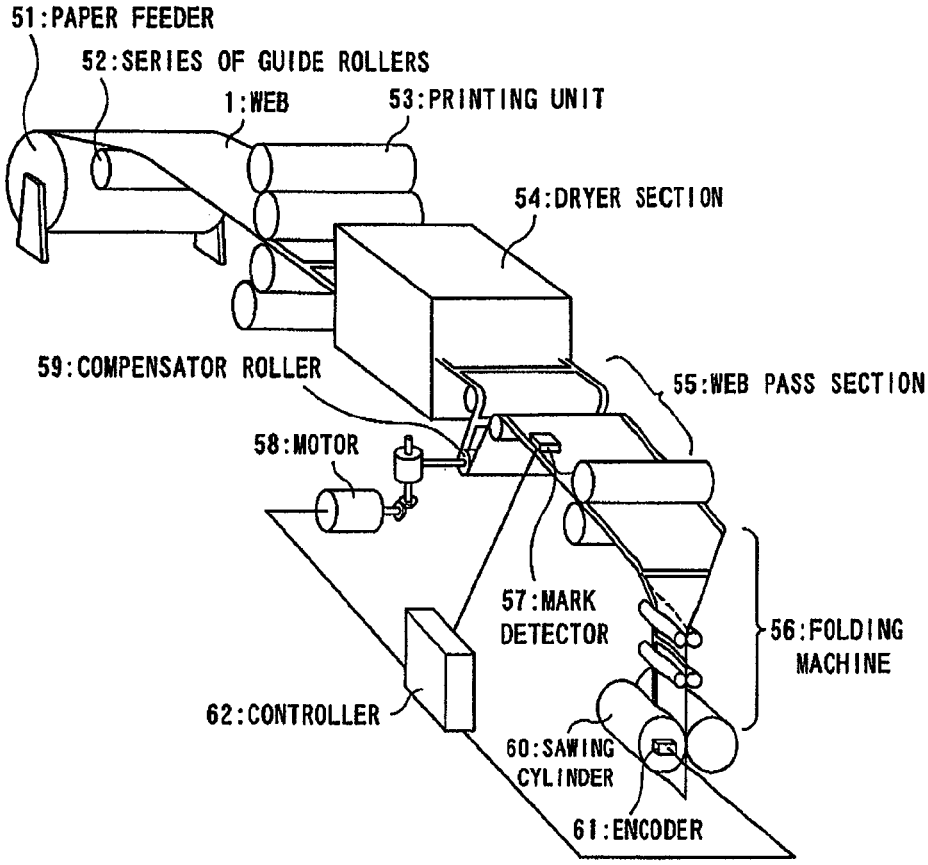
FIG. 10 Prior Art
FIG. 10 is a perspective view schematically showing a conventional web cutting-off control apparatus.

Based on the position of the mark 2 detected, as shown in FIG. 8, a cut-off controller 62A controls a motor 58 to adjust the position of a compensator roller 59. As shown in FIG. 9, the adjustment of the position of the compensator roller 59 increases or reduces the travel path length of the web 1, whereby the cutting-off position of the web 1 is adjusted.

In this manner, since the cutting-off control apparatus of the preferred embodiment is able to detect the marks on the web 1 at the start of printing, the cutting-off position of the web 1 can be kept constant at an appropriate position. Thus, waste paper can be considerably reduced.

If the mark 2 is shifted due to expansion and contraction of the web 1, there are cases where the mark 2 cannot be detected during the period of the gate signal Gs. In such a case, like Gs1 and Gs2 shown by two-dot chain lines in FIG. 7, by shifting the timing of the gate signal back and forth by the amount of suitable cycles (e.g., 8 cycles) so that the gate signals Gs1 and Gs2 partially overlap with the original gate signal Gs, the detection of the mark 2 is performed. Accordingly, the mark 2 can be reliably detected. Thus, the cutting-off position of the web 1 can be adjusted.

Among a plurality of mark candidates, the mark detector 6 is moved to the mark candidate nearest to the current position of the mark detector 6, so the time to move the mark detector 6 can be reduced. Thus, the preparation time up to the start of printing can be shortened.

In addition, even if the drive motor 20 fails, the distance between the current position of the mark detector 6 and the position of the mark 2 has been displayed on the display 15. Therefore, by watching the display 15, the operator can learn which side and how far the mark detector 6 needs to be moved. Therefore, in the case where the mark detector 6 can be manually moved in the web width direction, it is possible for the operator to move the mark detector 6 to a desired position by hand-operated.

While the present invention has been described with reference to the preferred embodiment thereof, the invention is not to be limited to the details given herein, but may be modified within the scope of the invention hereinafter claimed.

Figure 11A:
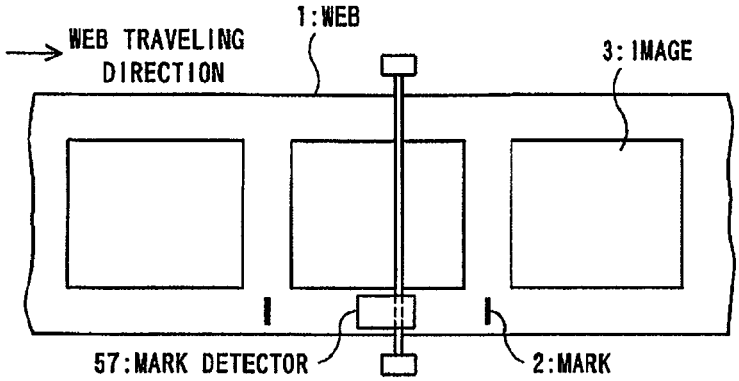
FIG. 11A Prior Art
FIG. 11A is a schematic plan view used for explaining the mark detector of the conventional web cutting-off control apparatus, cut register marks being located in one end of the web.
Figure 11B:
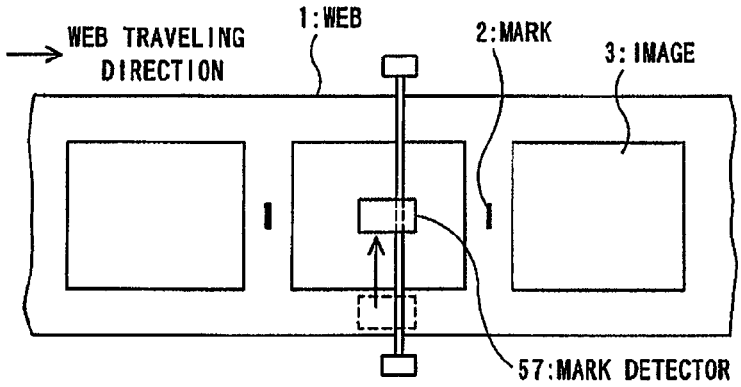
FIG. 11B Prior Art
FIG. 11B is a schematic plan view used for explaining the mark detector of the conventional web cutting-off control apparatus, each of the register marks being located between images.
Figure 11C:
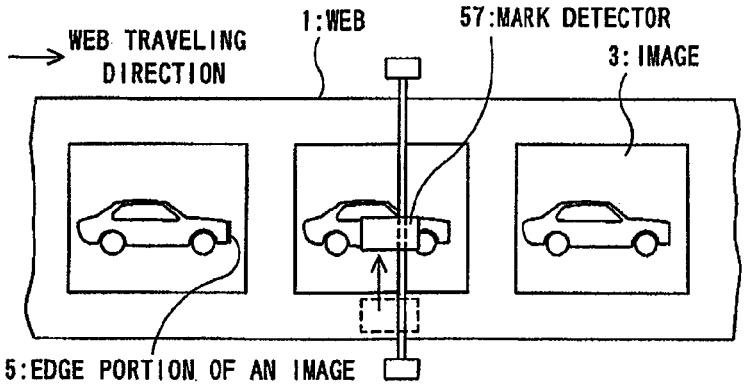
FIG. 11C Prior Art
FIG. 11C is a schematic plan view used for explaining the mark detector of the conventional web cutting-off control apparatus, a specified portion of an image being used as a mark equivalent.

For example, in the preferred embodiment, like an edge portion of an image shown in FIG. 11C, a mark equivalent, which is a specified portion of an image considered as a cut mark, is employed as the mark 2. However, as shown in FIGS. 11A and 11B, a dedicated cut register mark may be employed as the mark 2.

In the preferred embodiment, based on the position of the mark 2 calculated by the mark position calculation means 12, the controller 13 controls the drive means 14 to move the mark detector 6. However, without providing an automatic system for moving the mark detector 6, only an auxiliary cutting-off unit, which is constructed so as to display the positional relationship between the current position of the mark detector 6 estimated by the current position estimation means 16 and the position of the mark 2, may be provided. With this auxiliary unit, the operator can be urged to move the mark detector 6, and the operator can also be notified how far the mark detector 6 needs to be moved. Accordingly, by watching the display 15, the operator is able to directly move the mark detector 6 before the start of printing.

As with the above case, without providing an automatic system for moving the mark detector 6, only an auxiliary cutting-off unit, which is constructed so as to schematically display the positional relationship between the current position of the mark detector 6 estimated by the current position estimation means 16 and the position of the mark 2, may be provided. Even in this case, the operator can be urged to move the mark detector 6, and by watching the display 15, the operator is able to directly move the mark detector 6 before the start of printing.

Even in the case where the above-described auxiliary cutting-off unit is provided, as in the case of the preferred embodiment, it is possible to previously move the mark detector 6 to an appropriate position at the start of printing. That is to say, the mark 2 on the web 1 can be detected at the start of printing and the cutting-off position of the web 1 can be kept constant, so that waste paper can be appreciably reduced.

In addition to a schematic image showing the positional relationship between the current position of the mark detector 6 and the position of the mark 2, the distance between the current position of the mark detector 6 and the position of the mark 2 may be displayed on the display 15.

Note that as a means of moving the mark detector 6 in the web width direction, a well-known direct-acting unit may be employed.

What is claimed is:

1. A cutting-off control apparatus for a printing machine comprising:

a sawing cylinder for cutting off a web which has images printed thereon;

a mark detector provided upstream of said sawing cylinder for detecting marks on said web;

a reference signal generator for outputting an output signal according to cutting-off timing at which said web is cut off by said sawing cylinder;

a compensator roller for increasing or reducing a travel path length of said web, based on a difference between the cutting-off timing at which said web is cut off by said sawing cylinder and timing at which each of the marks is detected by said mark detector, to adjust a cutting-off position at which said web is cut off by said sawing cylinder;

a positional relationship acquisition means for previously obtaining a desired positional relationship between a position in a web traveling direction of each of marks to be printed on said web and a target cutting-off position of said web; and a detection timing control means for controlling mark detection timing so that the detection of each of the marks by said mark detector is performed during a specified period based on said desired positional relationship and a phase difference between the cutting-off timing at which said web is cut off and the output signal from said reference signal generator.

2. The cutting-off control apparatus as set forth in claim 1, further comprising:

an image data storage means for storing a first image data for plate making or second image data obtained by processing said first image data; and an image data conversion means for converting a resolution of said first or second image data stored in said image data storage means to a resolution of said mark detector;

wherein said positional relationship acquisition means calculates the position in the web traveling direction of each of the marks relative to said target cutting-off position, based on image data converted by said image data conversion means.

3. The cutting-off control apparatus as set forth in claim 1, wherein said detection timing control means sets said mark detection timing based on the output signal from said reference signal generator and causes said mark detector to detect each of the marks at the set mark detection timing.

4. The cutting-off control apparatus as set forth in claim 3, wherein, when each of the marks is not detected as a result of attempted detection of each of the marks at said set mark detection timing by said mark detector, said detection timing control means shifts said set mark detection timing either back or forth and then causes said mark detector to detect each of the marks at a shifted mark detection timing.

5. The cutting-off control apparatus as set forth in claim 4, further comprising:

a mark position acquisition means for obtaining a position in a web width direction of each of the marks to be printed on said web;

a drive means for moving each of the marks detector in a width direction of said web; and a detector position control means for controlling said drive means based on the position in the web width direction of each of the marks obtained by said mark position acquisition means, before start of printing.

6. The cutting-off control apparatus as set forth in claim 1, further comprising:

a mark position acquisition means for obtaining a position in a web width direction of each of the marks to be printed on said web;

a drive means for moving said mark detector in a width direction of said web; and a detector position control means for controlling said drive means based on the position in the web width direction of each of the marks obtained by said mark position acquisition means, before start of printing.

7. The cutting-off control apparatus as set forth in claim 1, wherein each of the marks is a specified portion of each of said images printed on said web.

8. A cutting-off control method for a printing machine in which a compensator roller adjusts a cutting-off position at which a web is cut off by a sawing cylinder by increasing or reducing a travel path length of said web, based on a difference between cutting-off timing at which said web is cut off by said sawing cylinder and timing at which each of marks is detected by a mark detector provided upstream of said sawing cylinder, said method comprising:

a positional relationship acquisition step of previously obtaining a positional relationship between a desired position in a web traveling direction of each of marks to be printed on said web and a target cutting-off position of said web; and a mark detection timing control step of controlling mark detection timing so that the detection of each of the marks by said mark detector is performed during a specified period based on said desired positional relationship and a phase difference between the cutting-off timing at which said web is cut off and an output signal from a reference signal generator.

9. The cutting-off control method as set forth in claim 8, wherein said positional relationship acquisition step comprising:

an image data storage step of storing first image data for plate making or second image data obtained by processing said first image data;

an image data conversion step of converting a resolution of said first or second image data stored in said image data storage step to a resolution of said mark detector; and a mark position calculation step of calculating the position in the web traveling direction of each of the marks relative to said target cutting-off position, based on image data converted by said image data conversion step.

10. The cutting-off control method as set forth in claim 8, wherein said reference signal generator outputting the output signal according to the cutting-off timing at which said web is cut off by said sawing cylinder;

and wherein said detection timing control step causes said mark detector to detect each of the marks at a set mark detection timing.

11. The cutting-off control method as set forth in claim 10, wherein, when each of the marks is not detected as a result of attempted detection of each of the marks at said set mark detection timing by said mark detector, said detection timing control step shifts said set mark detection timing either back or forth and then causes each of the marks detector to detect a mark at a shifted mark detection timing.

12. The cutting-off control method as set forth in claim 11, further comprising:

a mark position acquisition step of obtaining a position in a web width direction of each of the marks to be printed on said web; and a detector position control step of moving said mark detector in a width direction of said web, based on the position in the web width direction of said mark obtained by said mark position acquisition step, before start of printing.

13. The cutting-off control method as set forth in claim 8, further comprising:

a mark position acquisition step of obtaining a position in a web width direction of each of the marks to be printed on said web; and a detector position control step of moving said mark detector in a width direction of said web, based on the position in the web width direction of each of the marks obtained by said mark position acquisition step, before start of printing.

14. The cutting-off control method as set forth in claim 8, wherein each of the marks is a specified portion of each of said images printed on said web.

15. A cutting-off control apparatus for a printing machine comprising:

a sawing cylinder for cutting off a web which has images printed thereon;

a mark detector provided upstream of said sawing cylinder for detecting marks on said web;

a reference signal generator for outputting an output signal according to a cutting-off timing at which said web is cut off by said sawing cylinder;

a compensator roller for increasing or reducing a travel path length of said web, based on a difference between the cutting-off timing and a timing at which each of the marks is detected by said mark detector, to adjust a cutting-off position at which said web is cut off by said sawing cylinder;

a production management system obtains a desired positional relationship between a position in a web traveling direction of each of marks to be printed on said web and a target cutting-off position of said web; and a controller electronically coupled to said sawing cylinder, said compensator roller, and said production management system; said controller controls a mark detection timing so that the detection of each of the marks by said mark detector is performed during a specified period based on said desired positional relationship and a phase difference between the cutting-off timing and the output signal from said reference signal generator.

16. The cutting-off control apparatus as set forth in claim 15, further comprising:

an image data storage for storing a first image data for plate making or a second image data obtained by processing said first image data; and a conversion server for converting a resolution of said first or second image data stored in said image data storage to a resolution of said mark detector;

wherein said production management system calculates the position in the web traveling direction of each of the marks relative to said target cutting-off position, based on image data converted by said conversion server.

17. The cutting-off control apparatus as set forth in claim 15, wherein said controller sets said mark detection timing based on the output signal from said reference signal generator and causes said mark detector to detect each of the marks at the set mark detection timing.

18. The cutting-off control apparatus as set forth in claim 17, wherein, when each of the marks is not detected as a result of attempted detection of each of the marks at said set mark detection timing by said mark detector, said controller shifts said set mark detection timing and causes said mark detector to detect each of the marks at a shifted mark detection timing.

19. The cutting-off control apparatus as set forth in claim 15, further comprising a driver for moving said mark detector in a width direction of said web, where in said production management system obtains a position in a web width direction of each of the marks to be printed on said web, and said controller controls said driver based on the position in the web width direction of each of the marks obtained by said production management system.

* * * * *